US009828838B2

(12) United States Patent
Lopez et al.

(10) Patent No.: US 9,828,838 B2
(45) Date of Patent: Nov. 28, 2017

(54) ADJUSTABLE FLOW CONTROL ASSEMBLIES, SYSTEMS, AND METHODS

(71) Applicant: HALLIBURTON ENERGY SERVICES, INC., Houston, TX (US)

(72) Inventors: Jean-Marc Lopez, Plano, TX (US); Stephen Michael Greci, Little Elm, TX (US); James Jun Kang, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/456,023

(22) PCT Filed: Jul. 25, 2013

(86) PCT No.: PCT/US2013/052088

§ 371 (c)(1),
(2) Date: Aug. 11, 2014

(87) PCT Pub. No.: WO2015/012846

PCT Pub. Date: Jan. 29, 2015

(65) Prior Publication Data

US 2016/0215598 A1 Jul. 28, 2016

(51) Int. Cl.

| | |
|---|---|
| ***E21B 31/14*** | (2006.01) |
| ***E21B 43/12*** | (2006.01) |
| ***E21B 43/08*** | (2006.01) |

(52) U.S. Cl.

CPC ..... *E21B 43/12* (2013.01); *E21B 43/088* (2013.01)

(58) Field of Classification Search

CPC ..... E21B 43/12; E21B 43/08; E21B 34/08

USPC ..... 166/373

See application file for complete search history.

(56) References Cited

U.S. PATENT DOCUMENTS

| | | | | |
|---|---|---|---|---|
| 2009/0151925 | A1 | 6/2009 | Richards et al. | |
| 2011/0073308 | A1 | 3/2011 | Assal et al. | |
| 2011/0297385 | A1 | 12/2011 | Dykstra et al. | |
| 2012/0181036 | A1* | 7/2012 | Holderman | E21B 43/12 166/316 |
| 2013/0048299 | A1 | 2/2013 | Fripp et al. | |
| 2013/0180727 | A1* | 7/2013 | Dykstra | E21B 34/08 166/373 |

FOREIGN PATENT DOCUMENTS

| | | |
|---|---|---|
| WO | 2013066295 | 5/2013 |

OTHER PUBLICATIONS

International Search Report and Written Opinion for related International Application No. PCT/US13/052088, dated Apr. 21, 2014, 16 pages.

* cited by examiner

*Primary Examiner* — Matthew R Buck
*Assistant Examiner* — Patrick Lambe
(74) *Attorney, Agent, or Firm* — Chamberlain Hrdlicka

(57) ABSTRACT

An assembly for restricting fluid flow into a completion string of a well and restricting fluids based on one or more fluid characteristics is presented. The assembly includes an adjustable inflow control device. The adjustable inflow control device is for restricting flow of production fluids into the completion string. The assembly also includes a first autonomous inflow control device fluidly coupled to the inflow control device for restricting fluids based on one or more fluid characteristics. Others systems and methods are presented.

20 Claims, 6 Drawing Sheets

ADJUSTABLE FLOW CONTROL ASSEMBLIES, SYSTEMS, AND METHODS

CROSS REFERENCE TO RELATED APPLICATIONS

This application is a national stage entry of PCT Patent Application Number PCT/US13/52088 filed on Jul. 25, 2013 entitled ADJUSTABLE FLOW CONTROL ASSEMBLIES, SYSTEMS, AND METHODS, the entire teachings of which are incorporated herein.

FIELD

The present disclosure relates generally to flow control in oil wells and more particularly, but not by way of limitation, to adjustable flow control assemblies, systems, and methods.

BACKGROUND

Hydrocarbons, e.g., crude Oil and natural gas, occur naturally in subsurface deposits. After such deposits are located in commercial amounts, an oil well is drilled to develop the resources. Once the drilling process is finished, the well is completed to facilitate production. During production it is desirable to control the flow in production zones of the well.

DETAILED DESCRIPTION OF ILLUSTRATIVE EMBODIMENTS

Figure 1:
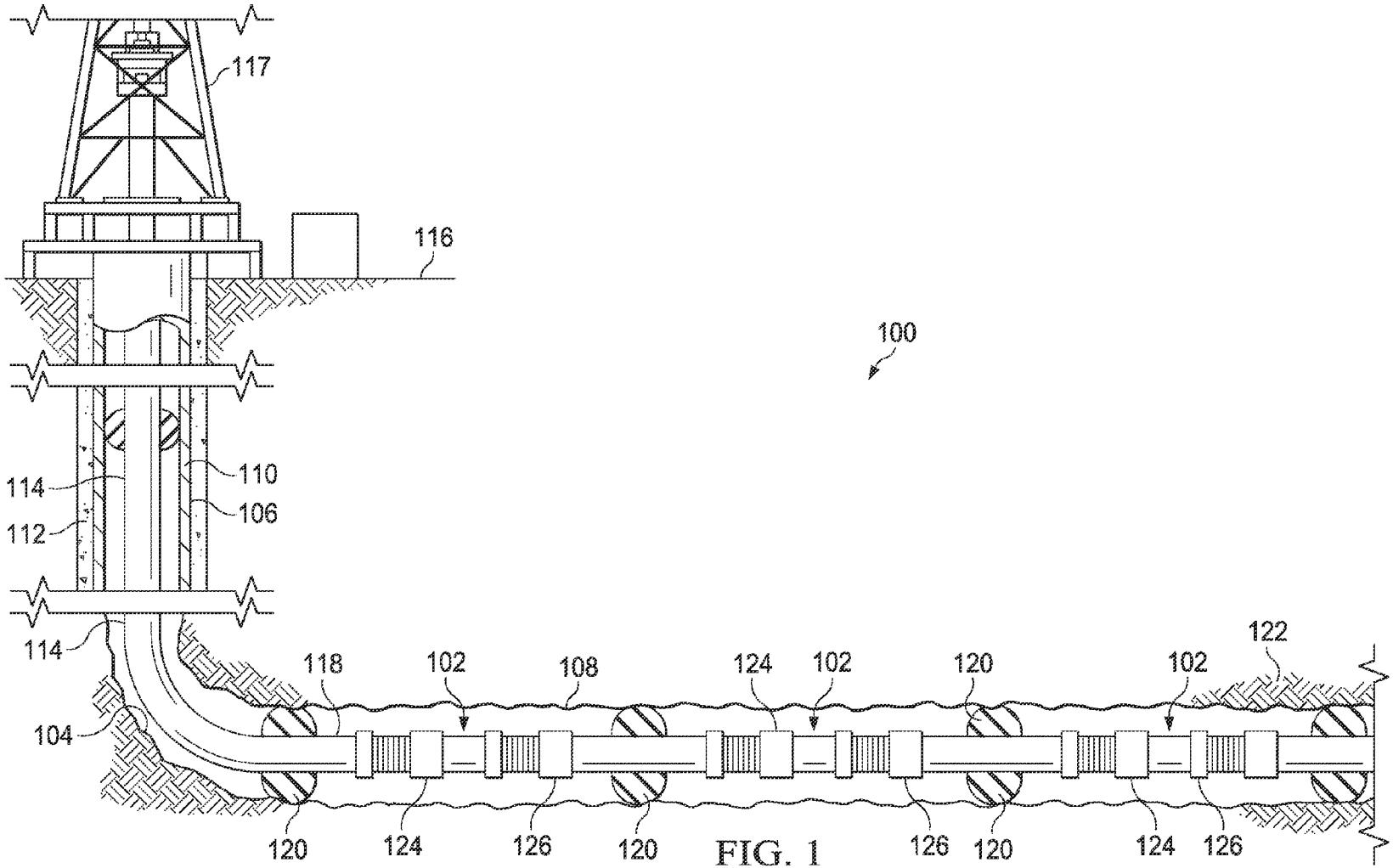
FIG. 1 is a schematic diagram of a well system including an illustrative embodiment of a plurality of assemblies for restricting fluid flow into a completion string and restricting fluids based on one or more fluid characteristics.

In the following detailed description of the illustrative embodiments, reference is made to the accompanying drawings that form a part hereof. These embodiments are described in sufficient detail to enable those skilled in the art to practice the invention, and it is understood that other embodiments may be utilized and that logical structural, mechanical, electrical, and chemical changes may be made without departing from the spirit or scope of the invention.

To avoid detail not necessary to enable those skilled in the art to practice the embodiments described herein, the description may omit certain information known to those skilled in the art. The following detailed description is, therefore, not to be taken in a limiting sense, and the scope of the illustrative embodiments are defined only by the appended claims.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The term "zone" or "pay zone" as used herein refers to separate parts of the wellbore designated for treatment or production and may refer to an entire hydrocarbon formation or separate portions of a single formation such as horizontally or vertically spaced portions of the same formation. Unless otherwise indicated, as used throughout this document, "or" does not require mutual exclusivity.

As used herein, the term "zonal isolation tool" will be used to identify any type of device operable to control the flow of fluids or isolate pressure zones within a wellbore, including but not limited to a bridge plug, a fracture plug, and a packer. The term zonal isolation tool may be used to refer to a permanent device or a retrievable device.

As used herein, the terms "seal", "sealing", "sealing engagement" or "hydraulic seal" are intended to include a "perfect seal", and an "imperfect seal. A "perfect seal" may refer to a flow restriction (seal) that prevents all fluid flow across or through the flow restriction and forces all fluid to be redirected or stopped. An "imperfect seal" may refer to a flow restriction (seal) that substantially prevents fluid flow across or through the flow restriction and forces a substantial portion of the fluid to be redirected or stopped.

Referring now to the drawings and initially to FIG. 1, a well system 100 including a plurality of flow control assemblies 102 for receiving desired fluids, such as heavy hydrocarbons, from a wellbore 104 while restricting undesired fluids, such as gas or water is presented. The assembly 102 restricts fluid flow into a completion string and restricts fluids based on one or more fluid characteristics.

The wellbore 104 extends through various earth strata. In this embodiment, the wellbore 104 includes a substantially vertical portion 106 and a substantially horizontal portion 108. An upper portion of the vertical portion 106 includes a casing or casing string 110 with cement 112 disposed between the wellbore 104 and the casing 110. A tubing string or tubing 114 is disposed within the wellbore 104 and extends from the surface 116. The tubing string 114 provides a conduit for moving production fluids to the surface 116, near derrick 117. A distal portion, or lower end, of the tubing string 114 is a fluidly coupled to a completion string 118 or a specialized portion of the tubing string 114. A plurality of zonal isolation tools 120, e.g., a swell packer, is used to form a plurality of production zones. The production zones or intervals are positioned adjacent to the target formation 122.

At this point, it should be noted that the well system 100 is illustrated in the drawings and is described herein as merely one example of a wide variety of well systems in which the principles of this disclosure can be utilized. It should be clearly understood that the principles of this disclosure are not limited at all to any of the details of the well system 100, or components thereof, depicted in the drawings or described herein.

For example, it is not necessary in keeping with the principles of this disclosure for the wellbore 104 to include a generally vertical wellbore section 106 or a generally horizontal wellbore section 104. It is not necessary for fluids to be only produced from the formation 122 since, in other examples, fluids could be injected into a formation, fluids could be both injected into and produced from a formation, etc.

Figure 2:
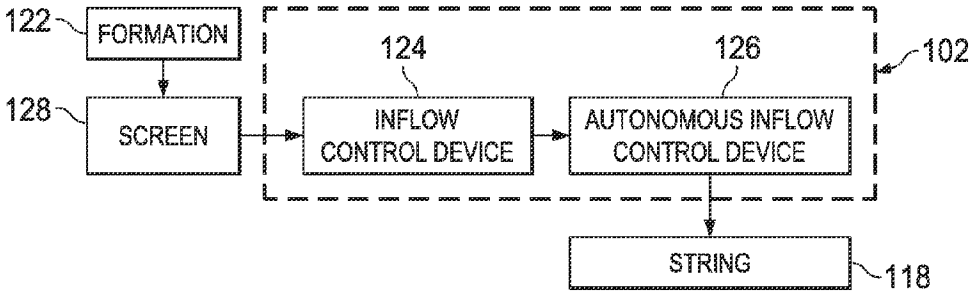
FIG. 2 is a schematic diagram presenting, inter alia, an illustrative embodiment of an assembly for restricting fluid flow into a completion string and restricting fluids based on one or more fluid characteristics.

Referring now primarily to FIGS. 1 and 2, the horizontal portion 108 of the wellbore 104 allows operators to exploit narrow, oil-bearing formations. Yet without more, the horizontal portion 108 can cause unwanted gas or water to migrate into the wellbore 104 because of heel-toe effect or other circumstances such as formation heterogeneities and or vertical fractions. Pressure restrictions are used control the flow in the production zones. The production zones are the spaces formed between adjacent isolation tools 120.

The completion string 118 includes the plurality of flow control assemblies 102. At least one flow control assembly 102 is typically disposed within each production zone or interval between isolation tools 120. Each flow control assembly 102 includes at least one inflow control device (ICD) 124 and at least one autonomous inflow control device (AICD) 126. The user can select the number of inflow control devices 124 and autonomous inflow control device 126 included with each joint or positioned within each production zone. The flow control assembly 102 may be placed downstream of a filter unit and upstream of inlet flow ports in a sand-screen base pipe or elsewhere.

The inflow control devices 124 help provide uniformity to the inflow by restricting high specific inflow segments or zones while increasing inflow from otherwise low productivity segments on zones. The inflow control devices 124 delay breakthrough of gas or water by typically creating a pressure drop along the completion string 118. For example, in a horizontal well, the inflow control devices are used to create an effective pressure drop or flow restriction in the heel that is greater than in the toe. The inflow control devices 124 may be selected from one or more of the following: orifice/nozzle (restrictive), helical-channel/labyrinth pathway (frictional), and hybrids (restrictive and frictional). The orifice/nozzle type inflow control devices use fluid constriction to produce differential pressure across the tool. The helical/labyrinth type inflow control devices use surface friction to produce a pressure drop. For example, a helical-channel design may include one or more flow channels wrapped around a base pipe of a screen. The hybrid design may use a series of flow passages (restrictive) but also include a series of bulkheads with slots.

The inflow control devices 124 that are controllable or able to be adjusted at the well site, which includes anywhere outside the manufacturing site, are referenced herein as adjustable inflow control devices. For example, the inflow control devices 124 may include a plurality of tubes that can be opened or plugged any time prior to running in the wellbore. As another alternative, the inflow control devices 124 may be adjustable by including a plurality of nozzles that can be intentionally opened or plugged any time prior to running in the wellbore. Other techniques may be used to adjust the inflow control devices 124.

The adjustable inflow control device 124 may be a tube-type that may be adjusted on-site by allowing tubes to be intentionally opened or plugged and can be adjusted any time prior to running in hole. In one illustrative, non-limiting embodiment, the adjustable tube inflow control device includes of six tubes with the following quantities and sizes: 3×0.125 inches (0.318 centimeters); 2×0.100 inches (0.254 centimeters); and 1×0.075 inches (0.191 centimeters). The user has a choice of how many of the six tubes will be open. Numerous types of inflow control devices may be used.

The adjustable tube inflow control device 124 may be the adjustable nozzle type. In one illustrative, non-limiting embodiment, the adjustable nozzle type inflow control device forces fluid through a long, square edged tungsten carbide nozzle to create a pressure restriction. This is an on-site adjustable device that allows nozzles to be intentionally opened or plugged and can be adjusted any time prior to running in hole. Again, numerous types of inflow control devices may be used.

As suggested in FIG. 2, fluid flows from the formation 122 through an optional screen 128 into the inflow control device 124. The fluid flows from the inflow control device 124 to the autonomous inflow control device 126 and then into the tubing of the completion string 118. One or more inflow control devices 124 may be included with each flow assembly 102, and one or more autonomous inflow control devices 126 may be included with each flow assembly 102. The screen 128 may be a swell screen, a wrap, a mesh, sintered, expanded, pre-packed, treat, or other screen type. In other embodiments, valves may be included for adjusting flow.

The autonomous inflow control devices 126 function like an inflow control device during production by creating or helping to create a pressure restriction, but at breakthrough the autonomous inflow control devices 126 also minimize the flow of water or gas. This additional functionality may be accomplished in a number of ways.

In one illustrative embodiment, the autonomous inflow control devices 126 use dynamic fluid technology to differentiate between fluid flowing in the device in order to maximize oil production. In this embodiment, the autonomous inflow control devices 126 work by directing fluid through different flow paths within the tool. Higher viscosity oil takes a short, direct path through the tool with a lower pressure differential, and water and gas spin at high velocities before flowing through an assembly, thereby experiencing a large pressure differential.

In one illustrative embodiment, the autonomous inflow control device 126 may include a viscosity selector, a flow switch, and a flow restrictor. The viscosity selector utilizes a system of flow paths which, based on fluid viscosity, density and velocity, directs the fluid that is flowing and divides the total flow among two flow paths. Based off the fluid selector's output the flow switch, or "fluid cross road" directs the majority of the selected fluid down one of two separate paths based on the fluid's characteristics. The fluid restrictor restricts the flow of unwanted fluid—gas or water—from entering the wellbore yet keeps the desired production flowing.

Figure 3:
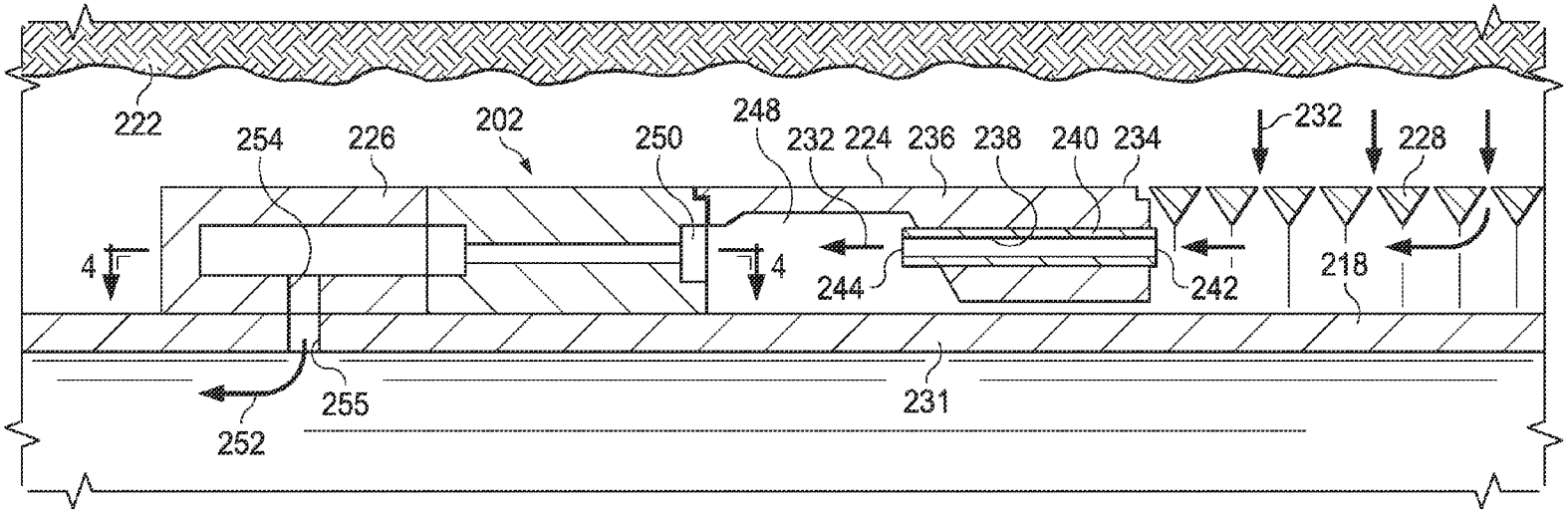
FIG. 3 is a schematic longitudinal cross section of a portion of a completion string showing an illustrative embodiment of assembly for restricting fluid flow into a completion string and restricting fluids based on one or more fluid characteristics.
Figure 4:
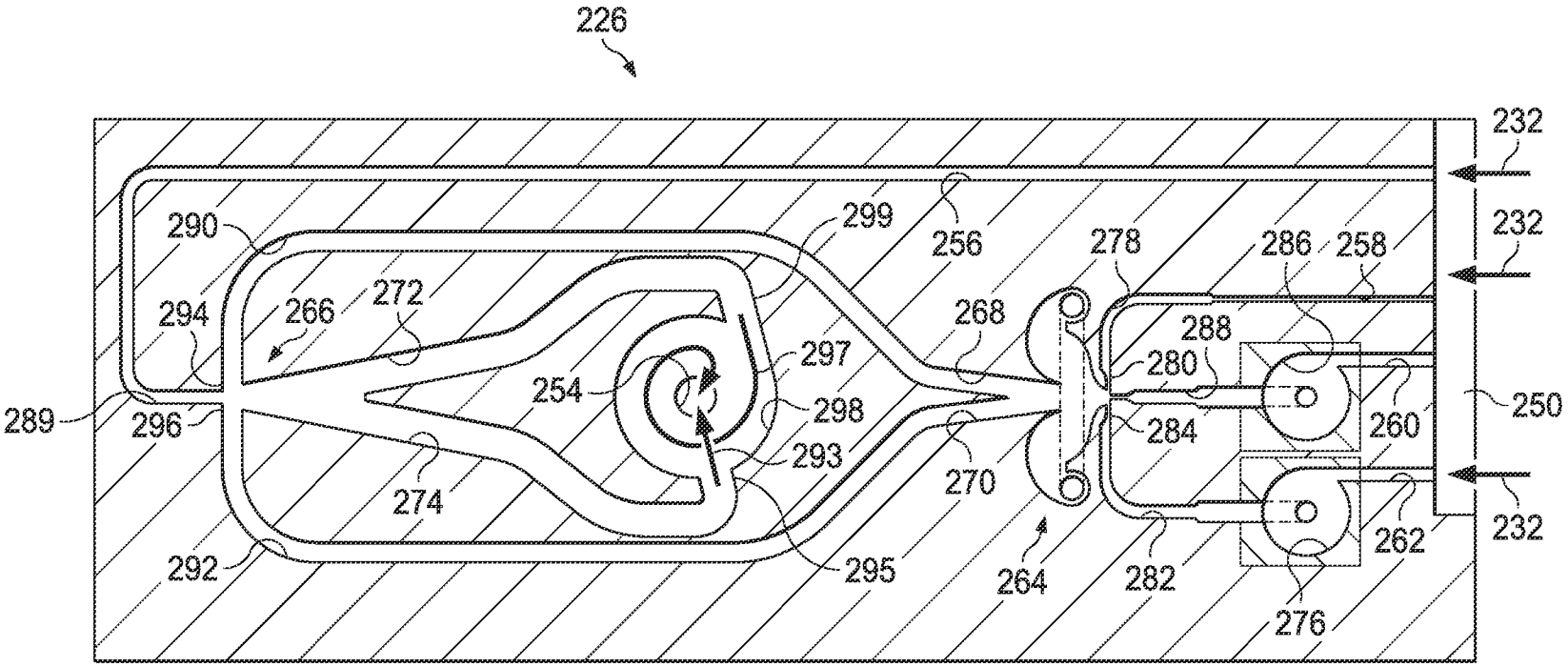
FIG. 4 is a schematic diagram of an autonomous inflow control device taken along 4-4 and circumferentially in FIG. 3 and "unrolled"

Referring now primarily to FIGS. 3 and 4, an illustrative, non-limiting embodiment of a flow control assembly 202 for restricting fluid flow into an interior of the completion string 218 and restricting fluids based on one or more fluid characteristics is presented. The assembly 202 is coupled to a base pipe 231, which is a portion of the completion string 218. The assembly 202 may include or be associated with a screen 228 that receives fluid 232 from the target formation 222. The flow control assembly 202 includes at least one inflow control device 224 and at least one autonomous inflow control device 226.

The fluid 232 flows through the screen 228 and into the inflow control device 224. The inflow control device 224 in this embodiment is an adjustable tube-type inflow control device 234. The tube-type inflow control device 234 includes a flow tube housing 236 coupled to a base pipe 231. The flow tube housing 236 includes a channel or aperture 238 that receives a flow tube or tube 240.

Each flow tube 240 has an inlet 242 and an outlet 244. The tube 240 restricts fluid flow and may be sized as appropriate for the desired pressure restriction. While only one portion of the flow tube housing 236 is shown and only one flow tube 240, it should be understood that additional tubes 240 may be placed circumferentially around the base pipe 231. In one illustrative, non-limiting embodiment, six tubes 240 are included ranging from 0.075 to 0.125 inches (0.191 to 0.318 centimeters) in diameter. Of course, other dimensions are contemplated and these dimensions are mentioned for illustration purposes only. The one or more of the tubes 240 may be plugged initially. The user may unplug as many of the tubes 240 as desired onsite to adjust the desired pressure restriction. In other embodiments, an eccentric design may be used with the inflow control devices primarily on one side or portion of the base pipe. This may be particularly advantageous in workover situations.

Fluid 232 exiting the ICD outlet 244 is delivered through a fluid chamber 248 to the autonomous inflow control device 226 and enters AICD inlet 250. In this example, the fluid composition 232 (which can include one or more fluids, such as oil and water, liquid water and steam, oil and gas, gas and water, oil, water and gas, etc.) flows initially into the well screen 228, is thereby filtered, flows through the inflow control devices 224, and then flows eventually into the AICD inlet 250 of the autonomous inflow control device 226, or variable flow resistance system. A fluid composition can include one or more undesired or desired fluids. Both steam and water can be combined in a fluid composition. As another example, oil, water or gas can be combined in a fluid composition.

Flow of the fluid composition 232 through the autonomous inflow control device 226 is resisted based on one or more characteristics (such as density, viscosity, velocity, etc.) of the fluid composition. This is important at breakthrough in order to maximize production. The fluid 252 is then discharged from the autonomous inflow control device 226 to an interior of the tubular string or completion string 218 via an AICD outlet 254 that is fluidly coupled to production port 255 in the base pipe 231.

In other examples, the well screen 228 may not be used in conjunction with the autonomous inflow control device 226 (e.g., in injection operations). The fluid composition 232 could also flow in an opposite direction through the various elements of the well system 100 (e.g., in injection operations). In some embodiments, a single autonomous inflow control device 226 could be used in conjunction with multiple well screens 228. In some embodiments, the autonomous inflow control devices 226 could be used with one or more well screens and the fluid composition could be received from or discharged into regions of a well other than an annulus or a tubular string. The fluid composition could flow through the autonomous inflow control device 226 prior to flowing through the well screen 228. Any components could be interconnected upstream or downstream of the well screen 228 or autonomous inflow control device 226, etc. Thus, it will be appreciated that the principles of this disclosure are not limited at all to the details of the example depicted in FIG. 3 and described herein.

Although the well screen 228 depicted in FIG. 3 is of the type known to those skilled in the art as a wire-wrapped well screen, any other types or combinations of well screens (such as sintered, expanded, pre-packed, wire mesh, etc.) may be used in other examples. Additional components (such as shrouds, shunt tubes, lines, instrumentation, sensors, inflow control devices, etc.) may also be used, if desired.

The autonomous inflow control device 226 is depicted in simplified form in FIG. 3, but in another example, the device can include various passages and devices for performing various functions. In addition, the device 226 may at least partially extend circumferentially about the string 218, or the device 226 may be formed in a wall of a tubular structure interconnected as part of the tubular string.

In other examples, the autonomous inflow control device 226 may not extend circumferentially about a tubular string or be formed in a wall of a tubular structure. For example, the autonomous inflow control device 226 could be formed in a flat structure, etc. The device 226 could be in a separate housing that is attached to the tubular string 218, or it could be oriented so that the axis of the outlet 254 is parallel to the axis of the tubular string. The device 226 could be attached to a device that is not tubular in shape. Any orientation or configuration of the system 25 may be used in keeping with the principles of this disclosure.

Referring additionally now to FIG. 4, a more detailed diagram of one example of the autonomous inflow control device 226 is representatively illustrated. The device 226 is depicted in FIG. 4 as if a cross section along the circumference was taken and is "unrolled" from its circumferentially extending configuration to a generally planar configuration.

As described above, the fluid composition 232 eventually enters the autonomous inflow control device 226 via the inlet 250, and exits the system via the outlet 254. A resistance to flow of the fluid composition 232 through the device 226 varies based on one or more characteristics of the fluid composition.

In the illustrative example of FIG. 4, the fluid composition 232 initially flows into multiple flow passages 256, 258, and 262. The flow passages 256, 258, and 262 direct the fluid composition 232 to two flow path selection devices 264 and 266. The flow path selection device 264 selects which of two flow paths 268, 270 a majority of the flow from the passages 258, 260, 262 will enter, and the other flow path selection device 266 selects which of two flow paths 272 and 274 a majority of the flow from the passages 256, 258, 260, 262 will enter.

The flow passage 258 is configured to be more restrictive to flow of fluids having higher viscosity. Flow of increased viscosity fluids will be increasingly restricted through the flow passage 258. As used herein, the term "viscosity" is used to encompass both Newtonian and non-Newtonian rheological behaviors. Related rheological properties include kinematic viscosity, yield strength, viscoplasticity, surface tension, wettability, etc. For example, a desired fluid can have a desired range of kinematic viscosity, yield strength, viscoplasticity, surface tension, wettability, etc.

The flow passage 258 may have a relatively small flow area. The flow passage may require the fluid flowing therethrough to follow a tortuous path. Surface roughness or flow impeding structures may be used to provide an increased resistance to flow of higher viscosity fluid, etc. Relatively low viscosity fluid, however, can flow through the flow passage 258 with relatively low resistance to such flow.

A control passage 278 of the flow path selection device 264 receives the fluid which flows through the flow passage 258. A control port 280 at an end of the control passage 278 has a reduced flow area to thereby increase a velocity of the fluid exiting the control passage.

The flow passage 262 is configured to have a flow resistance which is relatively insensitive to viscosity of fluids flowing therethrough, but which may be increasingly resistant to flow of higher velocity or higher density fluids. Flow of increased viscosity fluids may be increasingly resisted through the flow passage 262, but not to as great an extent as flow of such fluids would be resisted through the flow passage 258.

In the illustrative example depicted in FIG. 4, fluid flowing through the flow passage 262 flows through a "vortex" chamber 276 prior to being discharged into a control passage 282 of the flow path selection device 264. Since the chamber 276 in this example has a cylindrical shape with a central outlet, and the fluid composition 232 spirals about the chamber, increasing in velocity as it nears the outlet, driven by a pressure differential from the inlet to the outlet, the chamber is referred to as a "vortex" chamber. In other examples, one or more orifices, venturis, nozzles, etc. may be used. The control passage 282 terminates at a control port 284. The control port 284 has a reduced flow area, in order to increase the velocity of the fluid exiting the control passage 282.

It will be appreciated that, as a viscosity of the fluid composition 232 increases, a greater proportion of the fluid composition will flow through the flow passage 262, control passage 282 and control port 284 (due to the flow passage 258 resisting flow of higher viscosity fluid more than the flow passage 262 and vortex chamber 276). Conversely, as a viscosity of the fluid composition 232 decreases, a greater proportion of the fluid composition will flow through the flow passage 258, control passage 278, and control port 280.

Fluid which flows through the flow passage 260 also flows through a vortex chamber 286, which may be similar to the vortex chamber 276 (although the vortex chamber 286 in a this example provides less resistance to flow therethrough than the vortex chamber 276), and is discharged into a central passage 288. The vortex chamber 286 is used for "resistance matching" to achieve a desired balance of flows through the flow passages 258, 260, and 262.

Note that dimensions and other characteristics of the various components of the autonomous inflow control device 226 will need to be selected appropriately, so that desired outcomes are achieved. In the illustrative example of FIG. 4, one desired outcome of the flow path selection device 264 is that flow of a majority of the fluid composition 232 which flows through the flow passages 258, 260, 262 is directed into the flow path 268 when the fluid composition has a sufficiently high ratio of desired fluid to undesired fluid therein.

In this example, the desired fluid is oil, which has a higher viscosity than water or gas, and so when a sufficiently high proportion of the fluid composition 232 is oil, a majority (or at least a greater proportion) of the fluid composition 232 which enters the flow path selection device 264 will be directed to flow into the flow path 268, instead of into the flow path 270. This result is achieved due to the fluid exiting the control port 284 at a greater rate, higher velocity or greater momentum than fluid exiting the other control port 280, thereby influencing the fluid flowing from the passages 278, 282, 288 to flow more toward the flow path 268.

If the viscosity of the fluid composition 232 is not sufficiently high (and thus a ratio of desired fluid to undesired fluid is below a selected level), a majority (or at least a greater proportion) of the fluid composition which enters the flow path selection device 264 will be directed to flow into the flow path 270, instead of into the flow path 268. This will be due to the fluid exiting the control port 280 at a greater rate, higher velocity or greater momentum than fluid exiting the other control port 284, thereby influencing the fluid flowing from the passages 278, 282, 288 to flow more toward the flow path 270.

It will be appreciated that, by appropriately configuring the flow passages 258, 260, 262, control passages 278, 282, control ports 280, 284, vortex chambers 276, 286, etc., the ratio of desired to undesired fluid in the fluid composition 232 at which the device 264 selects either the flow passage 268 or 270 for flow of a majority of fluid from the device can be set to various different levels. The flow paths 268, 270 direct fluid to respective control passages 290, 292 of the other flow path selection device 266. The control passages 290, 292 terminate at respective control ports 294, 296. A central passage 289 receives fluid from the flow passage 256.

The flow path selection device 266 operates similar to the flow path selection device 264, in that a majority of fluid which flows into the device 266 via the passages 289, 290, 292 is directed toward one of the flow paths 272, 274, and the flow path selection depends on a ratio of fluid discharged from the control ports 294, 296. If fluid flows through the control port 294 at a greater rate, velocity or momentum as compared to fluid flowing through the control port 296, then a majority (or at least a greater proportion) of the fluid composition 232 will be directed to flow through the flow path 274. If fluid flows through the control port 296 at a greater rate, velocity or momentum as compared to fluid flowing through the control port 294, then a majority (or at least a greater proportion) of the fluid composition 232 will be directed to flow through the flow path 272.

Although two of the flow path selection devices 264, 266 are depicted in the example of the autonomous flow control device 226 in FIG. 4, it will be appreciated that any number (including one) of flow path selection devices may be used in keeping with the principles of this disclosure. The devices 264, 266 illustrated in FIG. 4 are of the type known to those skilled in the art as jet-type fluid ratio amplifiers, but other types of flow path selection devices (e.g., pressure-type fluid ratio amplifiers, bi-stable fluid switches, proportional fluid ratio amplifiers, etc.) may be used in keeping with the principles of this disclosure.

Fluid which flows through the flow path 272 enters a flow chamber 298 via an inlet 299 which directs the fluid to enter the chamber generally tangentially (e.g., the chamber 298 is shaped similar to a cylinder, and the inlet 299 is aligned with a tangent to a circumference of the cylinder). As a result, the fluid will spiral about the chamber 298, until it eventually exits via the outlet, as indicated schematically by arrow 297 in FIG. 4.

Fluid which flows through the flow path 274 enters the flow chamber 298 via an inlet 295 which directs the fluid to flow more directly toward the outlet 254 (e.g., in a radial direction, as indicated schematically by arrow 293 in FIG. 4). As will be readily appreciated, much less energy is consumed at the same flow rate when the fluid flows more directly toward the outlet 254 as compared to when the fluid flows less directly toward the outlet.

Thus, less resistance to flow is experienced when the fluid composition 232 flows more directly toward the outlet 254 and, conversely, more resistance to flow is experienced when the fluid composition flows less directly toward the outlet. Accordingly, working upstream from the outlet 254, less resistance to flow is experienced when a majority of the fluid composition 232 flows into the chamber 298 from the inlet 295, and through the flow path 274.

A majority of the fluid composition 232 flows through the flow path 274 when fluid exits the control port 294 at a greater rate, velocity or momentum as compared to fluid exiting the control port 296. More fluid exits the control port 294 when a majority of the fluid flowing from the passages 278, 282, 288 flows through the flow path 268. A majority of the fluid flowing from the passages 278, 282, 288 flows through the flow path 268 when fluid exits the control port 284 at a greater rate, velocity or momentum as compared to fluid exiting the control port 280. More fluid exits the control port 284 when a viscosity of the fluid composition 232 is above a selected level.

Thus, flow through the autonomous inflow control device 226 is resisted less when the fluid composition 232 has an increased viscosity (and a greater ratio of desired to undesired fluid therein). Flow through the autonomous inflow control device 226 is resisted more when the fluid composition 232 has a decreased viscosity.

More resistance to flow is experienced when the fluid composition 232 flows less directly toward the outlet 254 (e.g., as indicated by arrow 297). Thus, more resistance to flow is experienced when a majority of the fluid composition 232 flows into the chamber 298 from the inlet 299, and through the flow path 272.

A majority of the fluid composition 232 flows through the flow path 272 when fluid exits the control port 296 at a greater rate, velocity or momentum as compared to fluid exiting the control port 294. More fluid exits the control port 296 when a majority of the fluid flowing from the passages 278, 282, 288 flows through the flow path 270, instead of through the flow path 268. A majority of the fluid flowing from the passages 278, 282, 288 flows through the flow path 270 when fluid exits the control port 280 at a greater rate, velocity or momentum as compared to fluid exiting the control port 284. More fluid exits the control port 280 when a viscosity of the fluid composition 232 is below a selected level.

As described above, the autonomous inflow control device 226 is configured to provide less resistance to flow when the fluid composition 232 has an increased viscosity, and more resistance to flow when the fluid composition has a decreased viscosity. This is beneficial when it is desired to flow more of a higher viscosity fluid, and less of a lower viscosity fluid (e.g., in order to produce more oil and less water or gas).

If it is desired to flow more of a lower viscosity fluid, and less of a higher viscosity fluid (e.g., in order to produce more gas and less water, or to inject more steam and less water), then the autonomous inflow control device 226 may be readily reconfigured for this purpose. For example, the inlets 299, 295 could conveniently be reversed, so that fluid which flows through the flow path 272 is directed to the inlet 88, and fluid which flows through the flow path 274 is directed to the inlet 299.

The autonomous inflow control device 226 presented is an illustrative, non-limiting embodiment, and other embodiments and variation may utilized with the flow control assembly. In other embodiments, an autonomous inflow control device with valves may be used.

With respect to each flow control assembly, numerous permutations are possible with respect to the number and order of the inflow control devices and the autonomous flow control devices. For example, without limitation, the flow control assembly may have one inflow control device and two autonomous inflow control devices. The autonomous inflow control devices may be standalone, separately-housed units or may be in a common compartment.

Figure 5:
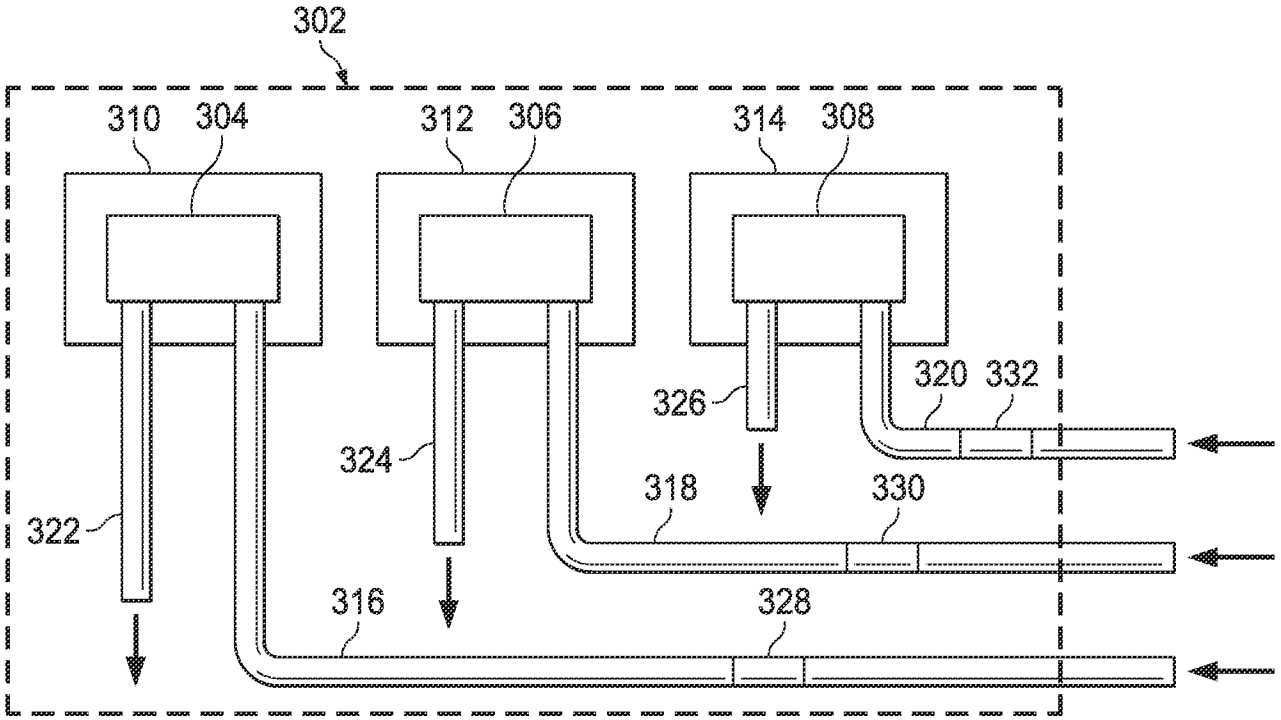
FIG. 5 is a schematic diagram showing an illustrative embodiment of a plurality of assemblies for restricting fluid flow into a completion string and restricting fluids based on one or more fluid characteristics.

For example, without limitation, referring now primarily to FIG. 5, a flow control assemblies 302 is shown having a first autonomous inflow control device 304, a second autonomous inflow control device 306, and a third autonomous inflow control device 308. Alternatively, each of the autonomous inflow control devices or some sub-combination may form the flow control assembly. As shown, each of the autonomous inflow control devices 304, 306, and 308 has a separate housing 310, 312, and 314. Each of the autonomous inflow control devices 304, 306, and 308 has inlet tubes 316, 318, 320 and outlet tubes 322, 324, 326. The outlet tubes 322, 324, and 326 are fluidly coupled to an interior of a completion string. The inlet tubes 316, 318, 320 may all include inflow control devices 328, 330, 332. In other embodiments, the inflow control device may be omitted for one or more of the inlet tubes 316, 318, 320. In another embodiment, the length of the inlet tubes 316, 318, 320 may be varied to act as an inflow control device. In other words, similar to a helix-type ICD, the length of the tube can be used to cause the pressure restriction using friction. The embodiment of FIG. 5 allows one to readily select exactly the number of autonomous inflow control devices desired since they are in different compartments.

Figure 6:
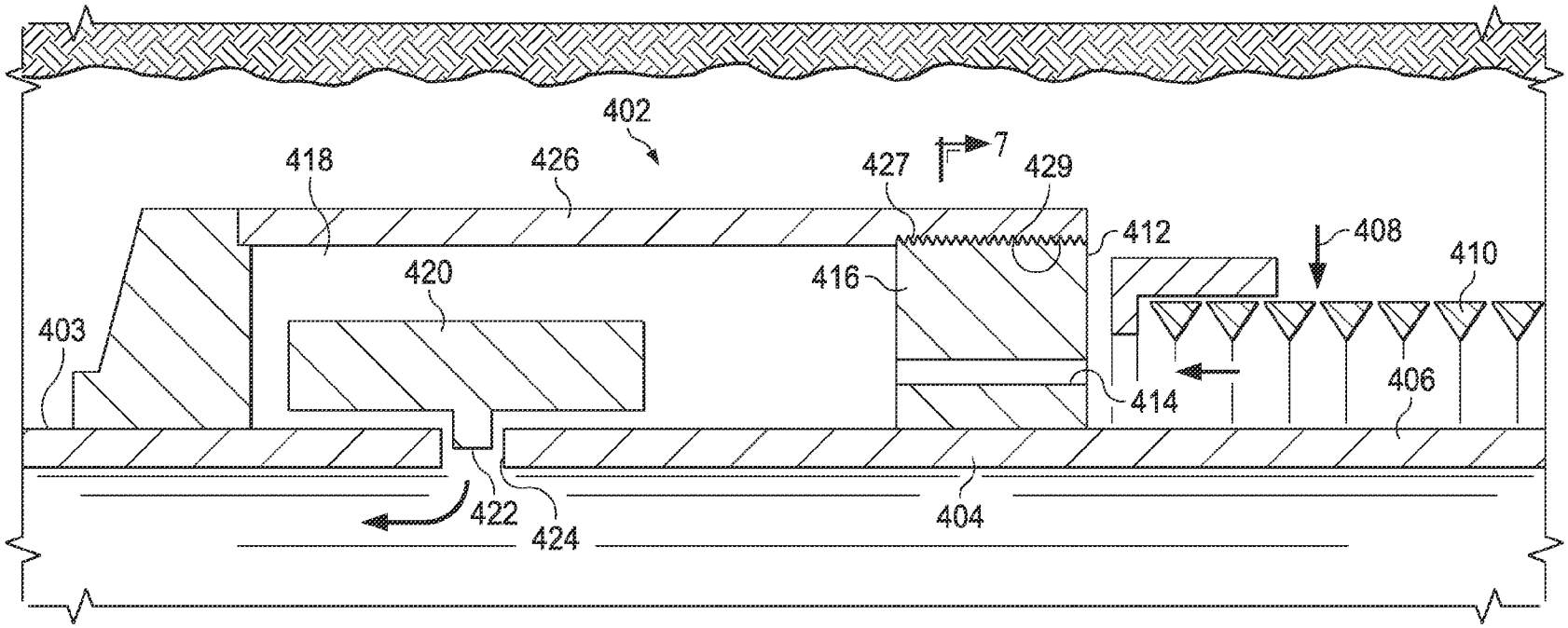
FIG. 6 is another illustrative embodiment of an assembly for restricting fluid flow into a completion string and restricting fluids based on one or more fluid characteristics.

Referring now primarily to FIG. 6, another illustrative, non-limiting embodiment of a flow control assembly 402 is presented. The flow control assembly 402 is shown on an exterior 403 of a base pipe 404 of a completion string 406. Production fluid 408 enters optional screen 410 from the wellbore and flows into an inflow control device 412 having a restriction 414 in a body 416. The restriction 414 may be an aperture or channel or may include a tube. Numerous tubes may be included circumferentially. The fluid exits the inflow control device 412 into a common fluid compartment 418 and into an autonomous inflow control device 420. The autonomous inflow control device 420 has outlet 422 that is fluidly coupled to a production port 424 into the interior of the completion string 406.

Figure 7:
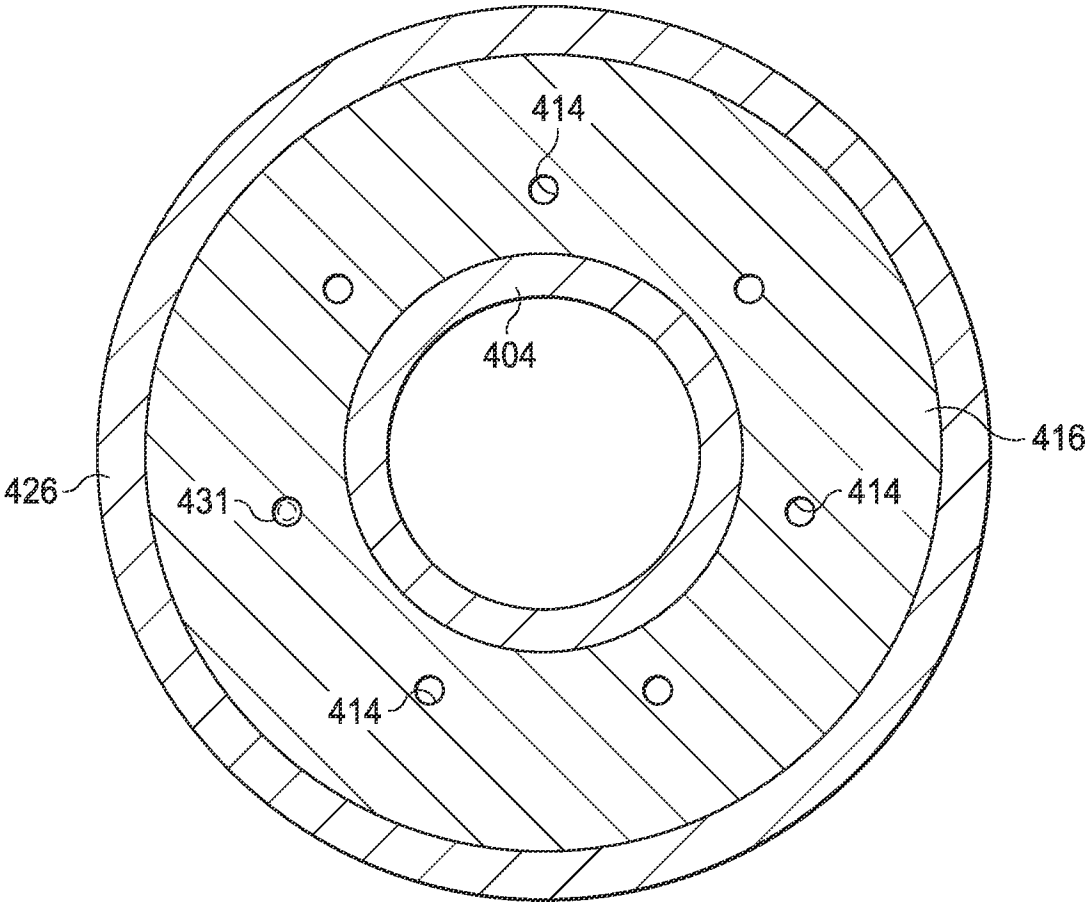
FIG. 7 is a cross section taken along line 7-7 in FIG. 6 and including the full circumference.

The flow control assembly 402 includes a sliding sleeve or cover 426. A threaded ring 427 forms an aspect of the inflow control device 412. The threaded ring 427, which has exterior threads 429 for mating with the sliding sleeve or cover 426, includes a plurality of restrictions 414, e.g., channels or apertures, installed into the flow path directly before the autonomous inflow control device 420. The restrictions 414 may be at least partially threaded to receive and mate with a cap 431. Each of the restrictions 414 may be capped (block all flow through that particular restriction 414) with threaded screws or caps 431 to restrict the flow entering the autonomous inflow control device 420. For illustrations purposes, FIG. 7 shows only one restriction 414 capped by the cap 431. The amount of flow entering the autonomous inflow control device 420 can be controlled by the number of restrictions 414 capped. The cap installation can be done at the surface by unthreading the sliding sleeve 426 to gain access to the threaded ring 427 and removing or installing as many caps 431 as desired. The inflow control device 412 may arrive at the worksite with any number of the restrictions 414 capped.

One advantage of the flow control assemblies herein is that potentially more efficient supply services for wells may be provided. When only an autonomous inflow control device has been used for flow control before and after breakthrough, the autonomous inflow control device had to be custom made or stocked in great numbers to accommodate different flow characteristics desired for a particular formation or region. If manufacturing of the autonomous inflow control device was behind, this became a significant issue. With the flow control assemblies herein, autonomous inflow control devices may be manufactured with a standard setting for the formations in a region of the world and the adjustable inflow control devices may then be used onsite to adjust the overall flow characteristics or pressure restrictions for the particular formation being developed. This approach also allows for more fined tuned pressure restrictions.

For example, according to one non-limiting embodiment, completion of a well in a specific formation in a production region of the world could include providing a plurality of adjustable inflow control devices that can be adjusted onsite. Any of the types of inflow control devices referenced earlier may be used provided that the user may adjust them in some fashion onsite. The approach also includes providing a plurality of autonomous inflow control devices having a flow characteristics adjusted for a typical maximum condition for formations in the specific region of the world. The formation and typical viscosity of the production fluid of a region impact the degree of pressure restriction needed on average.

If the average or typical well in a region, say the North Sea, has historically required or based on analysis will likely require a flow characteristic that typically is satisfied with two tubes in an autonomous flow control device, then the autonomous inflow control devices sent for stock in the region would have that setting or some average initial setting. Similarly, other types of autonomous inflow control may be in other ways for the region. Then when the flow characteristics desired for a specific formation are determined through experience or modeling, the inflow control device(s) that will be associated with the autonomous inflow control device(s) is adjusted to achieve the specific flow characteristics or pressure restriction desired. Thus, the overall flow control assembly will have the desired results and was able to be adjusted onsite.

As the well is completed, a plurality of production zones are established using isolation tools, and at least one of the flow control assemblies is disposed within a production zone. Often, although not required, there would be one flow control assembly in each of the production zones.

According one illustrative embodiment, a system for producing hydrocarbons from a formation includes a tubing string extending from a surface location into a wellbore and a completion string fluidly coupled to the tubing string for extending into a target formation and producing fluids from the target formation. The completion string includes a plurality of isolation tools forming a plurality of production zones; at least one adjustable inflow control device disposed within a first production zone of the plurality of production zones; and at least one autonomous inflow control device serially and fluidly coupled to the at least one adjustable inflow control device and disposed within the first production zone.

Numerous variations of the system of the preceding paragraph are possible. For example, the at least one inflow control device may be an adjustable nozzle inflow control device, an adjustable tube inflow control device, an adjustable helix inflow control device, or other flow restricting device. As another example, the completion string comprises at least two autonomous inflow control devices disposed in a production zone of the plurality of production zones. As another example, the completion string may include at least two autonomous inflow control devices disposed in a production zone of the plurality of production zones, and the at least two autonomous inflow control devices may share a common fluid compartment or may have separate fluid compartments. The isolation tool may be any of the previously mentioned types. One or more sand screens may be included.

In the illustrative embodiments of the preceding two paragraphs, the at least one inflow control device may include a flow tube housing coupled to a base pipe of the completion string, and at least one flow tube positioned within the flow tube housing having a flow tube inlet and a flow tube outlet. In addition, the at least one autonomous inflow control device may include a first flow passage fluidly coupled to the flow tube outlet; a first set of one or more branch passages which intersect the first flow passage, whereby a proportion of the fluid composition diverted from the first flow passage to the first set of branch passages varies based on at least one of a) viscosity of the fluid composition in the first flow passage, and b) velocity of the fluid composition in the first flow passage. The first set of branch passages directs the fluid composition to a first control passage of a flow path selection device. The flow path selection device selects which of multiple flow paths a majority of fluid flows through from the device, based at least partially on the proportion of the fluid composition diverted to the first control passage. The flow path selection device variably resists flow of the fluid composition in at least one direction between an interior of the completion string and the wellbore.

According to another illustrative embodiment, an assembly for restricting fluid flow into a completion string and restricting fluids based on one or more fluid characteristics includes an adjustable inflow control device, the adjustable inflow control device for restricting flow of production fluids into the completion string; and a first autonomous inflow control device fluidly coupled to the inflow control device for restricting fluids based on one or more fluid characteristics. Numerous types of adjustable flow control devices may be used, such as an adjustable nozzle inflow control device, adjustable tube inflow control device, an adjustable helix inflow control device, or other type.

Numerous variations of the assemblies of the preceding paragraph are possible. For example, the assembly may further include a second autonomous inflow control device fluidly coupled to the inflow control device for restricting fluids based on one or more fluid characteristics. Again numerous inflow control devices and autonomous inflow control devices may be utilized; for example, the adjustable inflow control device may include a flow tube housing coupled to a base pipe of the completion string, and at least one flow tube positioned within the flow tube housing having a flow tube inlet and a flow tube outlet. In addition, the autonomous inflow control device may include a first flow passage fluidly coupled to the flow tube outlet; a first set of one or more branch passages which intersect the first flow passage, whereby a proportion of the fluid composition diverted from the first flow passage to the first set of branch passages varies based on at least one of a) viscosity of the fluid composition in the first flow passage, and b) velocity of the fluid composition in the first flow passage. The first set of branch passages directs the fluid composition to a first control passage of a flow path selection device. The flow path selection device selects which of multiple flow paths a majority of fluid flows through from the device, based at least partially on the proportion of the fluid composition diverted to the first control passage. The flow path selection device variably resists flow of the fluid composition in at least one direction between an interior of the completion string and the wellbore.

According to another illustrative embodiment, a method of providing formation-specific flow control in a wellbore located in a production region of the world includes: providing a plurality of adjustable inflow control devices that can be adjusted onsite; providing a plurality of autonomous inflow control devices having a flow characteristics adjusted for a typical condition for formations in the production region of the world; determining the flow characteristics desired for a specific formation in the region from which production is desired; adjusting the plurality of adjustable inflow control devices to obtain the desired flow characteristics; forming a plurality of production zones in the wellbore; and disposing at least one of the plurality of inflow control devices and one of the plurality of autonomous inflow control devices in one of the production zones.

In the illustrative method of the previous paragraph, numerous combinations and permutation may be realized. For example, the step of providing a plurality of adjustable inflow control devices may include providing a plurality of adjustable nozzle inflow control device, a plurality of adjustable tube inflow control devices, a plurality of adjustable helix inflow control devices, or other types.

Although the present invention and its advantages have been disclosed in the context of certain illustrative, non-limiting embodiments, it should be understood that various changes, substitutions, permutations, and alterations can be made without departing from the scope of the invention as defined by the appended claims. It will be appreciated that any feature that is described in connection to any one embodiment may also be applicable to any other embodiment.

It will be understood that the benefits and advantages described above may relate to one embodiment or may relate to several embodiments. It will further be understood that reference to "an" item refers to one or more of those items.

The steps of the methods described herein may be carried out in any suitable order, or simultaneously where appropriate.

Where appropriate, aspects of any of the examples described above may be combined with aspects of any of the other examples described to form further examples having comparable or different properties and addressing the same or different problems.

It will be understood that the above description of preferred embodiments is given by way of example only and that various modifications may be made by those skilled in the art. The above specification, examples and data provide a complete description of the structure and use of exemplary embodiments of the invention. Although various embodiments of the invention have been described above with a certain degree of particularity, or with reference to one or more individual embodiments, those skilled in the art could make numerous alterations to the disclosed embodiments without departing from the scope of the claims.

We claim:

1. A system for producing hydrocarbons from a formation, the system comprising:

a tubing string extending from a surface location into a wellbore;

a completion string fluidly coupled to the tubing string for extending into a target formation and producing fluids from the target formation; and wherein the completion string comprises:

a plurality of isolation tools forming a plurality of production zones, at least one adjustable inflow control device configured to restrict fluid flow therethrough by non-autonomously adjusting the at least one adjustable inflow control device, the at least one adjustable inflow control device disposed within a first production zone of the plurality of production zones, and at least one autonomous inflow control device configured to autonomously restrict fluid flow therethrough based upon one or more fluid characteristics, the at least one autonomous inflow control device serially and fluidly coupled to the at least one adjustable inflow control device and disposed within the first production zone such that all fluid that flows into the at least one adjustable inflow control device flows into the at least one autonomous inflow control device before flowing into the completion string.

2. The system of claim 1, wherein the at least one adjustable inflow control device comprises an adjustable nozzle inflow control device.

3. The system of claim 1, wherein the at least one adjustable inflow control device comprises an adjustable tube inflow control device.

4. The system of claim 1, wherein the at least one adjustable inflow control device comprises an adjustable helix inflow control device.

5. The system of claim 1, wherein the completion string comprises at least two autonomous inflow control devices disposed in a production zone of the plurality of production zones.

6. The system of claim 1, wherein the completion string comprises at least two autonomous inflow control devices disposed in a production zone of the plurality of production zones, and wherein the at least two autonomous inflow control devices share a common fluid compartment.

7. The system of claim 1, wherein the completion string comprises at least two autonomous inflow control devices disposed in a production zone of the plurality of production zones, and wherein the at least two autonomous inflow control devices have separate fluid compartments.

8. The system of claim 1, wherein the isolation tool comprises a swell packer.

9. The system of claim 1, further comprising a sand screen upstream of the at least one adjustable inflow control device.

10. The system of claim 1, wherein the at least one adjustable inflow control device comprises:

a flow tube housing coupled to a base pipe of the completion string, and at least one flow tube positioned within the flow tube housing having a flow tube inlet and a flow tube outlet; and wherein the at least one autonomous inflow control device comprises:

a first flow passage fluidly coupled to the flow tube outlet, a first set of one or more branch passages which intersect the first flow passage, whereby a proportion of the fluid composition diverted from the first flow passage to the first set of branch passages varies based on at least one of a) viscosity of the fluid composition in the first flow passage, and b) velocity of the fluid composition in the first flow passage, wherein the first set of branch passages directs the fluid composition to a first control passage of a flow path selection device, wherein the flow path selection device selects which of multiple flow paths a majority of fluid flows through from the device, based at least partially on the proportion of the fluid composition diverted to the first control passage, and wherein the flow path selection device variably resists flow of the fluid composition in at least one direction between an interior of the completion string and the wellbore.

11. An assembly for restricting fluid flow into a completion string and restricting fluids based on one or more fluid characteristics, the assembly comprising:

an adjustable inflow control device configured to restrict fluid flow therethrough and into the completion string by non-autonomously adjusting the at least one adjustable inflow control device; and a first autonomous inflow control device configured to autonomously restrict fluid flow therethrough based upon one or more fluid characteristics, the first autonomous inflow control device serially and fluidly coupled to the adjustable inflow control device such that all fluid that flows into the adjustable inflow control device flows into the first autonomous inflow control device before flowing into the completion string.

12. The assembly of claim 11, wherein the adjustable flow control device comprises an adjustable nozzle inflow control device.

13. The assembly of claim 11, wherein the adjustable flow control device comprises an adjustable tube inflow control device.

14. The assembly of claim 11, wherein the adjustable flow control device comprises an adjustable helix inflow control device.

15. The assembly of claim 11, further comprising a second autonomous inflow control device fluidly coupled to the inflow control device for restricting fluids based on one or more fluid characteristics.

16. The assembly of claim 11, wherein the adjustable inflow control device comprises:

a flow tube housing coupled to a base pipe of the completion string, and at least one flow tube positioned within the flow tube housing having a flow tube inlet and a flow tube outlet; and wherein the first autonomous inflow control device comprises:

a first flow passage fluidly coupled to the flow tube outlet, a first set of one or more branch passages which intersect the first flow passage, whereby a proportion of the fluid composition diverted from the first flow passage to the first set of branch passages varies based on at least one of a) viscosity of the fluid composition in the first flow passage, and b) velocity of the fluid composition in the first flow passage, wherein the first set of branch passages directs the fluid composition to a first control passage of a flow path selection device, wherein the flow path selection device selects which of multiple flow paths a majority of fluid flows through from the device, based at least partially on the proportion of the fluid composition diverted to the first control passage, and wherein the flow path selection device variably resists flow of the fluid composition in at least one direction between an interior of the completion string and the wellbore.

17. A method of providing formation-specific flow control in a wellbore located in a production region of the world, the method comprising the steps of:

providing a plurality of adjustable inflow control devices, each configured to restrict fluid flow therethrough by non-autonomously adjusting the adjustable inflow control device onsite;

providing a plurality of autonomous inflow control devices, configured to autonomously restrict fluid flow therethrough based upon one or more fluid characteristics;

determining the flow characteristics desired for a specific formation in the region from which production is desired;

adjusting the plurality of adjustable inflow control devices to obtain the desired flow characteristics;

forming a plurality of production zones in the wellbore; and disposing at least one of the plurality of adjustable inflow control devices and at least one of the plurality of autonomous inflow control devices in one of the production zones with the at least one adjustable inflow control devices and the at least one autonomous inflow control device serially and fluidly coupled to each other such that all fluid that flows into the at least one adjustable inflow control device flows into the at least one autonomous inflow control device before flowing into the completion string.

18. The method of claim 17, wherein the step of providing the plurality of adjustable inflow control devices comprises providing a plurality of adjustable nozzle inflow control devices.

19. The method of claim 18, wherein the step of adjusting the plurality of adjustable inflow control devices comprises adjusting one or more nozzles to prevent flow.

20. The method of claim 17, wherein the step of providing the plurality of adjustable inflow control devices comprises providing a plurality of adjustable tube inflow control devices.

* * * * *